US005965513A

United States Patent [19]

Allan et al.

[11] Patent Number: 5,965,513

[45] Date of Patent: Oct. 12, 1999

[54] ANTIMICROBIAL CLEANING COMPOSITIONS

[75] Inventors: Alexander Allan; Kenneth Leslie Rabone; Martin Sharples, all of Bebingtonl, United Kingdom

[73] Assignee: Lever Brothers Company, New York, N.Y.

[21] Appl. No.: 08/849,462

[22] PCT Filed: Nov. 28, 1995

[86] PCT No.: PCT/EP95/04724

§ 371 Date: Aug. 8, 1997

§ 102(e) Date: Aug. 8, 1997

[87] PCT Pub. No.: WO96/17918

PCT Pub. Date: Jun. 13, 1996

[30] Foreign Application Priority Data

Dec. 9, 1994 [GB] United Kingdom ..... 9424895
Mar. 10, 1995 [GB] United Kingdom ..... 9504827

[51] Int. Cl.[6] ..... C11D 17/00; C11D 3/37; C11D 9/00

[52] U.S. Cl. ..... 510/422; 510/421; 510/434; 510/477; 510/500; 510/501; 510/503

[58] Field of Search ..... 510/214, 421, 510/422, 424, 477, 434, 501, 503

[56] References Cited

U.S. PATENT DOCUMENTS

| | | | |
|---|---|---|---|
| 4,252,665 | 2/1981 | Casey et al. . | |
| 4,657,690 | 4/1987 | Grollier et al. . | |
| 4,752,467 | 6/1988 | Konrad et al. | 424/70 |
| 4,844,886 | 7/1989 | Hartmann et al. | 424/62 |
| 4,920,100 | 4/1990 | Lehman et al. | 514/23 |
| 4,983,317 | 1/1991 | Requejo et al. | 510/174 |
| 5,534,198 | 7/1996 | Masters et al. | 510/182 |

FOREIGN PATENT DOCUMENTS

| | | |
|---|---|---|
| 331489 | of 0000 | European Pat. Off. . |
| 467472 | of 0000 | European Pat. Off. . |
| 0331489 | 9/1989 | European Pat. Off. . |
| 3518929 | 11/1986 | Germany . |
| 1528592 | of 0000 | United Kingdom . |

*Primary Examiner*—Necholus Ogden
*Attorney, Agent, or Firm*—Neil Y. Gilbert, Esq.

[57] ABSTRACT

The present disclosure relates to a disinfecting compositions of pH 2–7 comprising:

a) 1–30 wt. % on product of an ethoxylated nonionic surfactant;

b) less than 50 wt. % of total surfactant of anionic surfactant;

c) 0.005–5 wt. % on product of a water-soluble, anionic polymer having an average molecular weight of less than 1,000,000, wherein, the ratio of polymer: nonionic is 0.1:1 or less; and d) 0.1–15 wt. % on product of an antimicrobial agent selected from the group comprising:

i) benzoic acid derivatives, dicarboxylic acids, $C_1$–$C_6$ alkanols and mixtures thereof.

12 Claims, No Drawings

ANTIMICROBIAL CLEANING COMPOSITIONS

TECHNICAL FIELD

The present invention relates to an antimicrobial cleaning composition and to a method of treating surfaces with the said composition.

BACKGROUND OF THE INVENTION

Hard-surface cleaning compositions generally comprise one or more surfactants, and, optionally, one or more hygiene agents.

Typically, the surfactants used in such cleaning compositions are selected from anionic, nonionic, amphoteric and cationic surfactants. Nonionics are very commonly used due to their effectiveness on fatty soils and the ease with which their foaming can be controlled. Of these surfactants, nonionics are reported as showing low biocidal activity, whereas certain anionic, cationic and amphoteric surfactants show biocidal activity under specific conditions of, for example, pH and concentration. However, the biocidal activity of surfactants is, with a few notable exceptions low and it is commonplace to add a separate hygiene agent to compositions.

Typical hygiene agents include, strong acids, alkali's, phenolics, and oxidants such as peracids and hypohalites. These, of which a typical example is hypochlorite, are generally highly reactive species which exhibit this reactivity in terms of one or more of, short shelf life, toxic, corrosive and irritant properties. In general, these reactive components are required at relatively high levels in formulations. Other less chemically reactive hygiene agents, such as 2,4,4'-trichloro-2'-hydroxy diphenyl ether (available in the marketplace as IRGASAN [RTM]), are effective at relatively low concentrations but are more expensive than simpler species and may be specific as regards their spectrum of activity. Many organic acids, including benzoic, salicylic and sorbic are known as preservatives in cosmetics and some food products, but these preservatives generally show lower biocidal activity than the above-mentioned chemically reactive hygiene agents when used at the same level.

Similar compositions are known outside of the field of hard surface cleaning. For example, EP 0331489 (PARKE DAVIS PTY.) discloses a formulation for the treatment of acne which comprises a surfactant and a biocide. The examples illustrate the invention by reference to combinations of specific surfactants with specific biocides. DE 3518929 (Hans-Joachim Gobel) disclose a formulation for the treatment of dandruff which comprises a commercially available hair washing composition, which is identified, but whose composition is not given, and salicylic acid. RO 64162 (MIRAJ, 1974) discloses an anti-dandruff lotion which contains 10–30% wt ethanol, water, 0.5–3% wt salicyclic acid, 0.5–3% wt fatty acid alkoyl-betaine amide and 0.1–1% wt undecylenic acid monoethanolamide. It is believed that the salicyclic acid in such formulations is present as a keratolytic agent: causing dead skin tissue to be shed.

In hard surface cleaning it is often necessary to disinfect a surface. A 'disinfectant' can be understood to be a hygiene agent which shows a 100,000 fold or better reduction in the number of viable microorganisms in a specified culture when used at a level of around 0.5 wt %. This is generally known as a 'log 5 kill'. Of the organic acids mentioned above, salicylic acid is generally regarded as the most effective biocide against common bacteria, but it's activity falls far short of that required of a disinfectant at practical concentrations.

Some surfactants have been found to potentiate the effects of certain hygiene agents. DE 3619375 (Henkel) discloses that alkyl polyglycoside (APG) surfactants show a synergy with alcohols and organic acids as regards hygiene. The examples disclose compositions which comprise APG and organic acids including salicylic acid. These compositions are used at strongly acidic pH, generally below pH 3.

In addition to surfactants and hygiene agents it is known to incorporate polymers in hard surface cleaning compositions.

U.S. Pat. No. 3,679,592 (1972) discloses alkaline, cleaning and soil preventative compositions which comprise surfactant and 1–10% wt, particularly 4%, of a film forming component. GB 1528592 (1978) discloses alkaline, floor cleaning compositions. U.S. Pat. No. 4,252,665 (1979) discloses aqueous, alkaline, hard surface cleaning compositions of pH 9–12 which comprise a 'detergency-boosting' acrylic copolymer having a molecular weight substantially in excess of 100,000 in combination with anionic surfactants.

U.S. Ser. No. 07/297,807, as described in EP 0467472 A2 (Colgate Palmolive) demonstrates that the incorporation of 2.3% of a 15–20% aqueous solution of the cationic polymer poly-[beta(methyl diethyl-ammonium) ethyl-methacrylate] in a mixed nonionic surfactant system for hard surface cleaning results in significant improvement of ease of subsequent re-cleaning of previously soiled and cleaned ceramic tiles. These cationic polymers are rather more expensive than commonplace acrylic and methacrylic polymers and some doubt has been cast upon the environmental acceptability of cationic species containing quaternary nitrogen.

U.S. Pat. No. 4,678,596 relates to a rinse aid formulation for HDW and MDW of pH 7.5–10 which comprises 5–60% nonionic surfactant (examples are 15%), preferably 2% wt of anionic poly(meth)acrylic acid polymer of molecular weight 1,000–50,000. The pH is limited by the stability of the composition (which is unstable at pH 7.0: see table 4 of citation).

U.S. Pat. No. 4,657,690 relates to a washing and foaming composition for hair and skin (pH range is 4.5–7.7) which comprises nonionic (around 5%) and poly(meth)acrylic acid (anionic polymer). The weight ratio of the anionic polymer to the nonionic surfactant is greater than 0.1:1, examples have 0.5–5% polymer and 0.5–7% nonionic with a lowest ratio of 0.2:1.

EP 0379256 (Colgate 1989) relates to stable acidic disinfectant liquid cleaning compositions which comprises, nonionic surfactants in a mixed system, organic acids, and an acid stable disinfectant of which quaternary nitrogen based materials are used in the examples. It is noted in the specification that a polymer can be present as a soil release agent.

BRIEF DESCRIPTION OF THE INVENTION

We have determined that a marked synergy is exhibited between alkoxylated alcohol surfactants and certain organic acids and alcohols. It is believed that alkoxylated alcohol surfactants are otherwise poorly biocidal at reasonable formulation pH's. In the presence of polymers the synergy is maintained and exploited to give a product which is both an effective cleaner and an effective biocide. It will be understood that both effective cleaning and biocidal activity are desirable in a hard surface cleaning composition for hygiene purposes as it is important to both to ensure a high kill of bacteria and removal soil so as to retard reinfection and regrowth of bacterial populations.

Accordingly a first aspect of the present invention relates to a disinfecting composition of pH 2–7 comprising:

a) 1–30% wt on product of an alkoxylated nonionic surfactant, b) less than 50% wt of total surfactant of anionic surfactant, and, c) 0.005–5% wt on product of a water soluble, anionic polymer having an average molecular weight of less than 1000000, wherein, the weight ratio of polymer ethoxylated nonionic is 0.1:1 or less, CHARACTERISED IN THAT the product further comprises:

d) 0.01–15% wt on product of an antimicrobial agent selected from the group comprising: benzoic acid derivatives, dicarboxylic acids, $C_1$–$C_6$ alkanols and mixtures thereof.

A second aspect of the present invention provides a process for disinfecting non-living surfaces which comprises the step of treating the surface with a composition of pH 2–7 comprising:

a) 1–30% wt on product of an alkoxylated nonionic surfactant, b) less than 50% wt of total surfactant of anionic surfactant, c) 0.005–5% wt on product of a water soluble, anionic polymer having an average molecular weight of less than 1000000, wherein, the ratio of polymer: nonionic is 0.1:1 or less, and, d) 0.1–15% wt on product of an antimicrobial agent selected from the group comprising: benzoic acid derivatives, dicarboxylic acids, $C_1$–$C_6$ alkanols and mixtures thereof.

As will be explained in greater detail below, a particular advantage of the present invention is that the nonionic rich/anionic poor surfactant system is able to interact both with the polymer to give improved cleaning and interact with the antimicrobial agent to give a synergistic antimicrobial action. Thus the important features of effective microbial kill and improved soil removal are both attained with a relatively simple and hence cost effective formulation.

DETAILED DESCRIPTION OF THE INVENTION

In order that the invention may be further understood it will be described hereafter with reference to preferred features and materials.

Nonionics

Nonionic, alkoxylated surfaccants are present in the compositions of the invention. These surfactants are believed to engage in a synergistic interaction with both the polymer, to improve cleaning and aid the removal of soil subsequently deposited and with the antimicrobial so as to improve the disinfecting qualities of the composition.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 3 to 10 moles of ethylene oxide per mole of coconut alcohol; condensates of alkylphenols whose alkyl group contains from 6 to 12 carbon atoms with 3 to 10 moles of ethylene oxide per mole of alkylphenol.

The preferred alkoxylated alcohol nonionic surfactants are ethoxylated alcohols having a chain length of C9–C11 and an EO value of at least 3 but less than 10. Particularly preferred nonionic surfactants include the condensation products of $C_{10}$ alcohols with 3–8 moles of ethylene oxide. The preferred ethoxylated alcohols have a calculated HLB of 10–16. 'IMBENTIN 91-35 OFA' (TM, ex. Kolb AG) a $C_{9\text{-}11}$ alcohol with five moles of ethoxylation had been found to be a suitable nonionic surfactant in compositions according to the invention.

The amount of nonionic detergent active to be employed in the composition of the invention will generally be from 0.1 to 30% wt, preferably from 1 to 20% wt, and most preferably from 3to 10% wt for non-concentrated products. Concentrated products will have 10–20% wt nonionic surfactant present, whereas dilute products suitable for spraying will have 0.1–5% wt nonionic surfactant present.

Antimicrobials

As mentioned above the antimicrobial agents used in the compositions of the present invention are benzoic acid derivatives, dicarboxylic acids, $C_1$–$C_6$ alkanols and mixtures thereof.

Typical levels of the antimicrobial agent in formulations range from 0.01 to 8%, with levels of 0.05–4 wt %, particularly around 2% being preferred for normal compositions and up to two or four times that concentration being present in so called, 'concentrated' products. Although both the normal and concentrated products can be used neat it will be commonplace for these to be diluted by the user before use. For sprayable products, which are seldom diluted prior to use, the concentration of the antimicrobial agent will be in the range 0.05–0.5% wt.

In general, whatever the strength of the product the ratio of the nonionic surfactant to the antimicrobial agent will preferably be in the range 50:1 to >1:1, more preferably 30:1 to >1:1 i.e. an excess of nonionic will be present relative to the antimicrobial.

Amongst the benzoic acid derivatives a preferred antimicrobial agent is salicylic acid, which gives better hygiene results than benzoic and shows a very marked improvement as compared with sorbic acid.

Alternative benzoic acid derivatives are the polyhydroxyl carboxylic acids in which at least two hydroxyl groups are present and at least one of the hydroxyl groups is ortho- to the carboxylic acid group. The remaining hydroxyl group or groups can be in the remaining ortho-, para- or meta-configurations. The polyhydroxyl carboxylic acids exhibit the same synergy as the mono hydroxylic acid derivative (salicylic acid) but are believed to be less irritant.

We have determined that, in the presence of nonionic surfactant, salicylic acid derivatives methylated at positions 3–6 exhibit an additional antimicrobial action over that obtained with salicylic acid. This is particularly true for gram positive bacteria and yeasts.

The preferred alkyl substituted ortho-hydroxy aromatic carboxylic acid of the general formula:

$$R_1—C_6H_3(OH)(COOH)$$

wherein $R_1$ is $C_{1-12}$ alkyl, and the hydroxyl group is ortho to the carboxyl group on the benzene ring structure.

Preferably the alkyl substituted ortho-hydroxy aromatic carboxylic acids are substituted at the 3, 4 or 5-position, relative to the carboxyl group. Preferred chain lengths for the alkyl group are $C_{1-6}$,with methyl substituted acids being particularly preferred. Particularly preferred acids are 2-hydroxy 5-methyl benzoic acid, 2-hydroxy 4-methyl benzoic acid and 2-hydroxy 3-methyl benzoic acid.

Amongst the dicarboxylic acids, succinic acid is preferred.

Amongst the alkanols, the $C_2$–$C_5$ alcohols are preferred. These include ethanol and isopropanol. Isopropanol has been found to be particularly effective and is particularly preferred among the alkanols.

Polymers

In the context of the present invention, anionic polymers are those which carry a negative charge or similar polymers in protonated form. Mixtures of polymers can be employed. It should be noted that the beneficial effect of anionic polymers is significantly reduced by the presence of anionic surfactants. For this reason, and for reasons elaborated below, the level of anionic surfactants in the compositions of the invention should be minimised.

The preferred polymers in embodiments of the present invention are polymers of acrylic or methacrylic acid or maleic anhydride, or a co-polymer of one or more of the same either together or with other monomers. Particularly suitable polymers include polyacrylic acid, polymaleic anhydride and copolymers of either of the aforementioned with ethylene, styrene and methyl vinyl ether.

The most preferred polymers are maleic anhydride co-polymers, preferably those formed with styrene, acrylic acid, methyl vinyl ether and ethylene. Preferably, the molecular weight of the polymer is at least, 5000, more preferably at least 50,000 and most preferably in excess of 100,000. As the molecular weight increases the cleaning benefit of the polymer is reduced. 'VERSICOL E11' (RTM) ex Allied Colloids has been found to be a suitable polymer.

Typically, the compositions comprise at least 0.01 wt % polymer, on product. Preferably the level of polymer is 0.05–5.0 wt % at which level the anti-resoiling benefits become particularly significant. More preferably 0.1–3.0 wt % of polymer is present. We have determined that higher levels of polymer do not give significant further advantage with common dilution factors, while increasing the cost of compositions. However, for very concentrated products which are diluted prior to use, the initial polymer level can be as high as 5% w.

Minors and Optional Components

The composition according to the invention can contain other minor, inessential ingredients which aid in their cleaning performance and maintain the physical and chemical stability of the product.

For example, the composition can contain detergent builders. In general, the builder, when employed, preferably will form from 0.1 to 25% by weight of the composition.

Optionally, the composition can include one or more amphoteric surfactants, preferably betaines, or other surfactants such as amine-oxide and alkyl-amino-glycinates. Betaines are preferred for reasons of cost, low toxicity (especially as compared to amine-oxide) and wide availability. It is believed that amphoteric surfactants show a slight synergy with some organic acids as regards antimicrobial effects.

Typical betaines in compositions according to the invention are the amido-alkyl belaines, particularly the amidopropyl betaines, preferably having an aliphatic alkyl radical of from 8 to 18 carbon atoms and preferably having a straight chain. These betaines are preferred as they are believed to comprise relatively low levels of nitrosamine precursors although other betaines, such as alkyl betaines, can be used in the compositions of the invention.

Typical levels of amphoteric range from 0.01 to 8%, with levels of 1–5 wt %, particularly around 2% being preferred for normal compositions and up to four times the concentration being present in so called, concentrated products. As with the nonionic surfactant, lower levels or around 0.05–1% will be employed in sprayable products and higher levels of, typically, around 4% wt in concentrates. In general, the ratio of the betaine to the aromatic carboxylic acid will be in the range 1:3 to 3:1, with approximately equal levels on a weight basis being preferred.

Metal ion sequestrants, including ethylenediaminetetraacetates, aminopolyphosphonates (such as those in the DEQUEST range) and phosphates and a wide variety of other poly-functional organic acids and salts, can also optionally be employed. It is believed that the hygiene performance of the composition is improved by the presence of a metal ion sequesterant.

Citrate is particularly preferred as this functions as a buffer maintaining the composition at a pH in the range 3–5 on dilution. Typical levels of citrate range from 0.5–5%, with higher levels of 5–10% being used in concentrates and lower levels of 0.1–1% being used in sprayable products. Citric can be replaced by other suitable buffering agents to maintain the pH in this range. Citric is also preferred for environmental reasons and a lack of residues as it is believed to be the most cost/weight-effective acid.

Hydrotropes, are useful optional components. It is believed that the use of hydrotropes enables the cloud point of the compositions to be raised without requiring the addition of anionic surfactants. The presence of both anionic surfactants and betaine is believed to be detrimental to the formulations as these surfactants interact with the amphoterics to form a complex which inhibits the synergistic hygiene activity of the amphoterics with the organic acid. Preferably the formations according to the invention are free of anionic surfactants when betaine is present, or contain low levels of anionic surfactants, i.e. less than 50% of the total level of surfactant present and preferably less than 50% of the level of the betaine in the product. Anionics are compatible with the solely alcohol ethoxylate based compositions of the present invention when the level is below 50% wt of the total surfactant present, but their level should be minimised in view of their interactions with the polymers. Preferably the level of anionic is below 30% of the total surfactant content of the composition and more preferably below 10% of the surfactant content. It is possible to make compositions which contain little or no anionic surfactant.

Suitable hydrotropes include, alkali metal toluene sulphonates, urea, alkali metal xylene and cumene sulphonates, polyglycols, >20 EO ethoxylated alcohols, short chain, preferably $C_2$–$C_5$ alcohols and glycols. Preferred amongst these hydrotropes are the sulphonates, particularly the cumene, xylene and toluene sulphonates.

Typical levels of hydrotrope range from 0–5% for the sulphonates. Correspondingly higher levels of urea and alcohols are required. Hydrotropes are not always required for dilute, sprayable products, but may be required if lower EO or longer alkyl ethoxylates are used or the cloud point needs to be raised considerably. With a product comprising 5% wt C9–C11 8 EO ethoxylated alcohol, 2% salicylate, 3.5% citrate and a 0.3% wt of a perfume: 3.4, 2.1 and 1.1% wt of sodium toluene-, sodium xylene- and sodium cumene-sulphonates were required respectively to achieve a cloud point at or above 50 Celcius. The cumene sulphonate is the most preferred hydrotrope.

Compositions according to the invention can also contain, in addition to the ingredients already mentioned, various other optional ingredients such as, solvents, colourants, optical brighteners, soil suspending agents, detersive enzymes, compatible bleaching agents, gel-control agents, freeze-thaw stabilisers, further bactericides, perfumes and opacifiers.

pH

Preferably the pH of the composition is 3.0–4.5. It is believed that above pH 4.5 the hygiene benefit of the compositions falls off and below pH 3.0 surface damage may occur. The preferred pH range is 3.2–4.0 in use. The most preferred pH is around 3.5. Compositions having a pH of less than 3.0 will damage enamel surfaces.

Compositions having a pH above 4.5 will show reduced kill against micro-organisms. In typical waters from hard water areas citrate at a level of 3.5% will be sufficient co reduce the pH on addition of the product of the present invention at 3.3 g/l to a pH below 4.0. It is believed that the relatively low pH of the composition is important in achieving both the cleaning and the antimicrobial synergies which are exhibited by the products according to the invention.

The most preferred formulations according to the present invention, excluding minors, comprise.

For general use products:

a) 3–10% wt of an ethoxylated alcohol nonionic surfactant having a C8–C14 alkyl radical and an ethoxylation value of 5–10, b) 1–4% wt of a benzoic acid derivative wherein each further substituent in the ring is selected from the group comprising H— and HO—, c) 0.1–3% wt of a polymers of acrylic or methacrylic acid or maleic anhydride, or a co-polymer of one or more of the same either together or with other monomers, and, d) 0–5% wt of an alkali metal sulphonate hydrotrope;

For concentrated products:

a) 10–20% wt of an ethoxylated alcohol nonionic surfactant having a C8–C14 alkyl radical and an ethoxylation value of 5–10, b) 2–8% wt of a benzoic acid derivative wherein each further substituent in the ring is selected from the group comprising H— and HO—, c) 0.1–3% wt of a polymers of acrylic or methacrylic acid or maleic anhydride, or a co-polymer of one or more of the same either together or with other monomers, and, d) 0–5% wt of an alkali metal sulphonare hydrotrope;

For sprayable products:

a) 1–5% wt of an ethoxylated alcohol nonionic surfactant having a C8–C14 alkyl radical and an ethoxylation value of 5–10, b) 0.05–1% wt of a benzoic derivative acid wherein each further substituent in the ring is selected from the group comprising H— and HO—, and, c) 0.1–1% wt of a polymers of acrylic or methacrylic acid or maleic anhydride, or a co-polymer of one or more of the same either together or with other monomers, and, d) 0–2% wt of an alkali metal sulphonate hydrotrope.

EXAMPLES

The following bacterial strains were used in the suspension tests.

| | |
|---|---|
| *Pseudomonas aeruginosa* | ATCC 15442 |
| *Staphylococcus aureus* | NCTC 6538 |

Microorganisms were taken from slopes and cultured at 37° C. (bacteria) or 28° C. (yeast) with constant agitation for 24 hours in nutrient broth (bacteria) or Sabouraud-dextrose liquid (yeast). Cells were recovered by centrifugation (10 min, 4100 rpm) and resuspended in ¼ strength Ringer's buffer to give a suspension of $10^9$–$10^{10}$ cfus/ml.

Test solutions were freshly prepared in sterile distilled water and the pH adjusted accordingly. Sufficient bacterial suspension was added to each test solution to give a final concentration of $10^8$ bacteria/ml. After a 5 min contact time, 1 ml of the test solution was added aseptically to 9 ml of inactivation liquid (3% (w/v) Tween 80 (TM), 0.3% (w/v) Lecithin, 0.1% (w/v) Bacteriological Peptone made up in pH 7.2 phosphate buffer) and then serially diluted into ¼ strength Ringer's buffer. Viable organisms were determined by culturing on Nutrient or Tryptone-soya peptone agar (bacteria) and Malt Extract agar (yeast) for 48 hours at 37° C. (bacteria) or 28° C. (yeast).

Table 1.2 shows the selective synergy between nonionic surfactant and salicylic acid at pH 4.0 against *S. aureus*. In the figure the components are identified as in Table 1.1 below. 'Versicol E11' (ex allied colloids) is a polyacrylic acid polymer at the pH of the product.

TABLE 1.1

| Code | Component | Level when present |
|---|---|---|
| I | Imbentin 91/35/OFA | 7% |
| CA | Citric acid | 1% |
| S | Salicylate | 2% |
| STS | Sodium Toluene Sulphonate | 2.56% |
| P | Versicol E11 (RTM) | 0.5% |

Experiments were performed with one or more of the components listed in table 1.1 present. Results are presented in table 1.2 below. The compositions were not significantly thickened due to the presence of the polymer.

TABLE 1.2

| Present | Log Kill |
|---|---|
| I. | 0.5 |
| I.CA | 0.8 |
| I.CA.S | 5 |
| I.CA.STS | 0.4 |
| I.CA.P | 0.4 |
| I.CA.S.STS | 5 |
| I.CA.S.P | 3.5 |
| I.CA.S.P.STS | 4 |
| I.CA.P.STS | 0.5 |

From Table 1.2 it can be seen that the synergistic hygiene effect in the composition is due to the presence of both nonionic surfactant and the exemplary antimicrobial aromatic organic acid. It can also be seen that the presence of hydrotrope sodium toluene sulphonate and the polymer do not have a significantly detrimental effect on the hygiene performance of the composition.

Table 2.1 below gives additional disinfectant formulations and lists the Log Kill achieved against *Ps. aeruginosa*. *Ps. aeruginosa* is a gram-negative organism and is considered to be more difficult to kill than many other species of bacteria.

In this series of examples, 8 formulations were tested at a time in a 96 well (8×12) microtitre plate, using a test related to the 'European Suspension Test'.

1 ml of formulation was diluted into 14 ml of water of standard hardness (17 degrees German). 5 ml of the diluted solution was added to 4 ml of distilled water and 270 μl of the product dosed into one well of the microtitre plate. This was repeated for the remaining 7 formulations being tested on this plate. 8 wells were simultaneously inoculated with 30 μl bacterial suspension using a multipipette and agitated. After a 5 mins (+/−5 secs) contact time 30 μl samples were transferred into 270 μl inactivation liquid (as used in examples 1 and 2) using a multipipette and mixed. After 5 mins (+/−1 min) 30μ samples were serially diluted into 270 μl Ringers solution using a mutipipette and mixed. TVC was determined by a spread plate method: plating out 10 μl (in triplicate) onto TSA and incubating for 24 hours at 30° C.

Results are given in table 2.1 below for formulations comprising: Dobanol 91-8 (as surfactant), sodium toluene sulphonate (as hydrotrope: to a cloud point of 50 degrees), salicylic acid, polymer, citric acid (to pH 3.5), blue dye and one of two commercially available perfumes.

TABLE 2.1

| Example | Nonionic (Dobanol 91-8 [RTM]) | Hydrotrope STS | Polymer (Versicol E11 [RTM]) | Salicylic acid | Perf A. | Perf B. | Blue Dye | Log Kill |
|---|---|---|---|---|---|---|---|---|
| 3a | 0 | 0 | 0 | 0 | 0 | 0 | 0 | 0.2 |
| 3b | 5.25 | 6.2 | 0.25 | 2 | 0.3 | 0 | tr. | 6.3 |
| 3c | 8.75 | 3 | 0.25 | 2 | 0.3 | 0 | tr. | 6.1 |
| 3d | 5.25 | 6.8 | 0.25 | 2 | 0 | 0.2 | 0 | 6.9 |
| 3f | 8.75 | 4 | 0.25 | 2 | 0 | 0.2 | 0 | 6.3 |
| 3g | 5.25 | 5.1 | 0.25 | 2 | 0 | 0 | tr. | 6.0 |
| 3h | 8.75 | 3.8 | 0.25 | 2 | 0 | 0 | tr. | 5.8 |

From table 2.1 it can be seen that the presence of hydrotrope, polymers, perfume and dye has no significant detrimental effects on the log kill of the formulations, which achieved better than log 5 kill.

Tables 3.1 and 3.2 show the results of a further series of formulations according to the present invention. The nonionic surfactant was IMBENTIN 91-35 OFA (TM, ex. Kolb AG). The amphoteric surfactant was EMPIGEN BB (TM, ex Albright and Wilson). The polyacrylate was VERSICOL E11 (TM). Example A is a product suitable for general use, Example B is a concencrate and Example C a sprayable product.

TABLE 3.1

| Components | Example | | |
|---|---|---|---|
| (parts wt) | 3A | 3B | 3C |
| Nonionic | 7.0 | 14.0 | 2.0 |
| Polyacrylate | 0.5 | 1.0 | 0.14 |
| Salicylate | 2.0 | 4.0 | 0.1 |
| Amphoteric | 3.0 | 4.0 | 0.1 |
| Citric Acid | 3.5 | 7.0 | 0.3 |
| STS | 2.6 | 2.6 | 0.0 |
| pH | 3.5 | 3.5 | 3.7 |

Caustic soda was added Lo the indicated pH. Products were made up to 100 wt % with water. The performance of products was evaluated using the method of the European Suspension Test, as described above. Results for a range of microbes are shown for formulations 3A, 3B and 3C in table 3.2 below.

TABLE 3.2

| Microbe | Log Kills | | |
|---|---|---|---|
| | 3A | 3B | 3C |
| *P. mirablis** | 5.7 | 5.0 | — |
| *P. mirablis#* | 4.0 | 5.8 | — |
| *P. mirablis* | — | — | 9.8 |
| *E. faecium** | 6.0 | 6.0 | — |
| *E. faecium#* | 6.0 | 5.0 | — |
| *E. faecium* | — | — | 9.0 |
| *P. aeriginosa** | 4.5 | 4.0 | — |
| *P. aeriginosa#* | 4.5 | 4.5 | — |
| *P. aeriginosa* | — | — | 6.0 |
| *S. cerevisiae** | 1.0 | 1.0 | — |
| *S. cerevisiae#* | 7.0 | 6.0 | — |
| *S. cerevisiae* | — | — | 8.0 |
| *S. aureus** | 3.5 | 4.0 | — |
| *S. aureus#* | 5.8 | 7.8 | — |
| *S. aureus* | — | — | 6.0 |

*indicates high soil conditions
#indicates hard water was used

From the above results it can be seen that the compositions of the invention are effective against a range of microbes under a range of conditions.

Table 4.1 shows the relation between the cloud point of the compositions and the level and type of hydrotrope present. The compositions comprised 7% Dobanol 91-5 (TM), 2% Empigen BB (TM), 0.5% Versicol (TM) E11 polymer, 2% salicylate, 3.5% citric acid and were perfume free.

TABLE 4.1

| STS Level | Cloud Point (Celcius) | | |
|---|---|---|---|
| | 0% sal | 1% sal | 2% sal |
| 0 | 40 | — | 7 |
| 2.5 | 64 | 51 | 25 |
| 5 | >100 | >100 | 95 |

From these results it can be seen that the presence of the benzoic acid derivative progressively lowers the cloud point to the point where a cloudy product is obtained at room temperature. However, this defect can be cured by the addition of the hydrotrope.

We claim:

1. A hard surface cleaning and disinfecting composition of pH 2–7 comprising:

a) 1–30 wt. % on product of an ethoxylated nonionic surfactant;

b) less than 50 wt. % of total surfactant of anionic surfactant;

c) 0.005–5 wt. % on product of a water-soluble, anionic polymer having an average molecular weight of at least 50,000, wherein, the weight ratio of polymer:ethoxylated nonionic is 0.1:1 or less than 0.1:1; and d) 0.01–15 wt. % on product of an antimicrobial agent selected from the group comprising: benzoic acid derivatives, wherein the composition can achieve a log kill of at least about 5 against *Pseudomotias aeruginosa.*

2. Composition according to claim 1 comprising ethoxylated alcohol having a chain length of $C_8$–$C_{14}$ and 4–10 ethoxy groups per molecule.

3. Composition according to claim 1 comprising 0.01 to 8% wt, benzoic acid derivative.

4. Composition according to claim 1 wherein the weight ratio of the nonionic surfactant to the antimicrobial agent is in the range 50:1 to more than 1:1.

5. Composition according to claim 1 comprising salicylic acid.

6. Composition according to claim 1 comprising 0.01 to 8% wt amphoteric surfactant.

7. Composition according to claim 6 wherein the amphoteric surfactant comprises a betaine.

8. Composition according to claim 1 having a pH of 3.5–4.0.

9. Composition according to claim 1 comprising:

a) 3–10% wt of an ethoxylated alcohol nonionic surfactant having a $C_8$–$C_{14}$ alkyl radical and a mean ethoxylation value of 5–10, b) 1–4% wt of a benzoic acid derivative wherein each substituent in the ring, other than —COOH, is selected from the group comprising HO—, H— and $CH_3$—, c) 0.5–5% wt of citrate; and d) 0–5% wt of an alkali metal sulphonate hydrotrope.

10. Composition according to claim 1 comprising:

a) 10–20% wt of an ethoxylated alcohol nonionic surfactant having a $C_8$–$C_{14}$ alkyl radical and an ethoxylation value of 5–10, b) 2–8% wt of a benzoic acid derivative wherein each substituent in the ring, other than —COOH, is selected from the group comprising HO—, H— and $CH_3$—, c) 5–10% wt citrate; and d) 0–5% wt of an alkali metal sulphonate hydrotrope.

11. Composition according to claim 1 comprising a) 1–5% wt of an ethoxylated alcohol nonionic surfactant having a $C_8$–$C_{14}$ alkyl radical and an ethoxylation value of 5–10, b) 0.05–1% wt of a benzoic acid derivative wherein each substituent in the ring, other than —COOH, is selected from the group comprising HO—, H— and $CH_3$—; and c) 0.1–1% wt citrate; and d) 0–2% wt of an alkali metal suiphone hydrotrope.

12. Composition according to claim 1 wherein the log kill against *Ps aeruginosa* is at least about 6.

* * * * *